US008157601B2

(12) United States Patent
Lin et al.

(10) Patent No.: US 8,157,601 B2
(45) Date of Patent: Apr. 17, 2012

(54) CONTACT FOR ELECTRICAL CONNECTOR

(75) Inventors: Chun-Fu Lin, Tu-Cheng (TW); Ke-Hao Chen, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 11 days.

(21) Appl. No.: 12/883,358

(22) Filed: Sep. 16, 2010

(65) Prior Publication Data

US 2011/0065334 A1 Mar. 17, 2011

(30) Foreign Application Priority Data

Sep. 16, 2009 (TW) ..... 98131251

(51) Int. Cl.
*H01R 13/24* (2006.01)

(52) U.S. Cl. ..... 439/700; 439/786; 439/824

(58) Field of Classification Search ..... 439/790, 439/700, 482, 824, 786
See application file for complete search history.

(56) References Cited

U.S. PATENT DOCUMENTS

| | | | | |
|---|---|---|---|---|
| 7,025,602 | B1 | 4/2006 | Hwang | |
| 7,559,806 | B2 * | 7/2009 | Lin et al. | 439/700 |
| 7,841,864 | B2 * | 11/2010 | Hsiao et al. | 439/66 |
| 7,845,988 | B2 * | 12/2010 | Hsiao et al. | 439/700 |
| 8,033,872 | B2 * | 10/2011 | Yang et al. | 439/700 |
| 8,052,491 | B2 * | 11/2011 | Lin | 439/786 |
| 2010/0068947 | A1 * | 3/2010 | Hsiao et al. | 439/786 |

* cited by examiner

*Primary Examiner* — Hae Moon Hyeon
(74) *Attorney, Agent, or Firm* — Ming Chieh Chang; Wei Te Chung; Andrew C. Cheng

(57) ABSTRACT

A contact (1) includes a first contact pin (2), a second contact pin (3) and a spring (4). The first contact pin includes a mating end (26), a body (23) having a first body portion (232) and a second body portion (231), a pair of ear portions (24) and a pair of first blocking portions (22). The first body portion has a thickness greater than that of the second body portion. The second contact pin includes a pair of second blocking portions (32), and a pair of resilient beams (33) slidable between a latched position and an unlatched position. The resilient beams are confined by the ear portions. The resilient beams clasp the first body portion in the latched position. The spring is compressible between the pair of first blocking portions and the pair of second blocking portions.

20 Claims, 5 Drawing Sheets

CONTACT FOR ELECTRICAL CONNECTOR

BACKGROUND OF THE INVENTION

1. Field of the Invention

The present invention relates to a contact, and more particularly to a compressible contact for electrical connector.

2. Description of Related Art

U.S. Pat. No. 7,025,602 issued to Hwang on Apr. 11, 2006 discloses a contact for electrical connector. The contact comprises a first contact pin having a pair of first hooks and a first beam, a second contact pin having a pair of second hooks and a second beam, and a coiled spring surrounding around the first and second contact pins. The coiled spring is compressed between a latched position and an unlatched position. The first hooks engage with the second hooks under a force generated along the mating direction at the unlatched position. The first hooks engage with the second beam and the second hooks engage with the first beam at the latched position.

The first hooks and the second hooks could not engage with each other reliably. It is complicated to form the first hooks on the first contact pin and the second hooks on the second contact pin.

Hence, an improved contact for electrical connector is highly desired.

SUMMARY OF THE INVENTION

Accordingly, an object of the present invention is to provide a contact comprising a first contact pin and a second contact pin having simple configurations and being capable to establish a reliable engagement therebetween.

In order to achieve the object set forth, a contact includes a first contact pin, a second contact pin mating with the first contact pin along a mating direction and a spring. The first contact pin includes a mating end, a body having a first body portion and a second body portion, a pair of ear portions proximate to the mating end, and a pair of first blocking portions. The first body portion is distal from the mating end and has a thickness greater than that of the second body portion. The second contact pin includes a pair of second blocking portions, and a pair of resilient beams slidable between a latched position and an unlatched position. The resilient beams are confined by the ear portions to move along the mating direction. The resilient beams clasp the first body portion in the latched position. The spring is compressible between the pair of first blocking portions and the pair of second blocking portions.

It is easy to form a pair of ear portions on the first contact pin. The engagement between the ear portions of the first contact pin and the resilient beams of the second contact pin is reliable.

Other objects, advantages and novel features of the invention will become more apparent from the following detailed description when taken in conjunction with the accompanying drawings.

DETAILED DESCRIPTION OF THE PREFERRED EMBODIMENT

Figure 1:
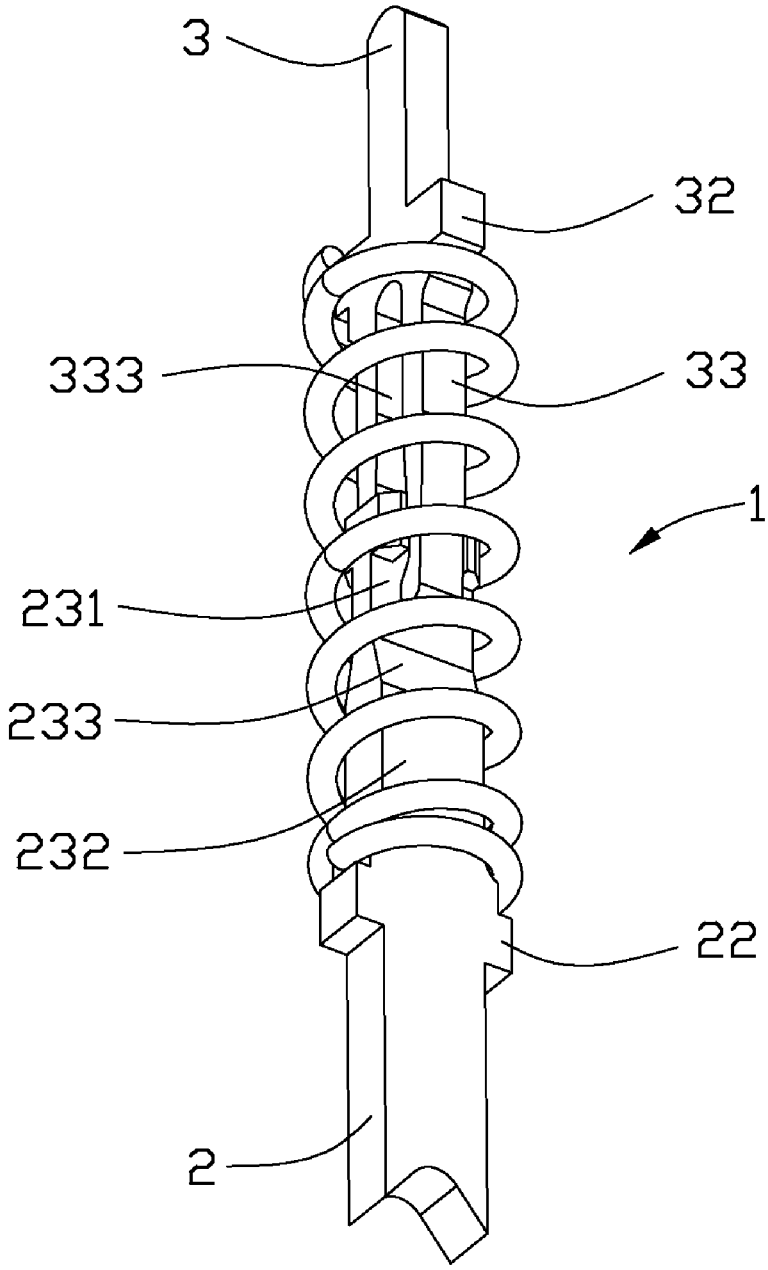
FIG. 1 is an assembled perspective view showing a contact disposed in an unlatched position in accordance with the present invention.

Reference will now be made in detail to the preferred embodiment of the present invention. Referring to FIGS. 1-5, a contact 1 applied in an electrical connector is mounted on a circuit board (not shown) and electrically connected with a chip (not shown). The contact 1 comprises a first contact pin 2, a second contact pin 3 and a coiled spring 4 surrounding the first contact pin 2 and the second contact pin 3.

The first contact pin 2 comprises a mating end 26, a body 23 and a mounting portion 21 opposite to the mating end 26 for being mounted on the circuit board. The first contact pin 2 includes a pair of opposite first side faces 201 and a pair of opposite second side faces 202. The first contact pin 2 further includes a pair of first blocking portions 22 protruding along a transverse direction from opposite first side faces 201.

The first contact pin 2 has a pair ear portions 24 proximate to the mating end 26 of the body 23. Each ear portion 24 is connected with the pair of second side faces 202 and protrudes along a longitudinal direction perpendicular to the transverse direction from the second side faces 202. Each second side face 202 has a groove 25 defined between the pair of ear portions 24. The body 23 comprises a first body portion 232, a second body portion 231, and an obliquely extending connecting portion 233 between the first and the second body portions 232, 231. The second body portion 231 is nearer to the mating end 26 than the first body portion 232. The second body portion 231 has a thickness thinner than that of the first body portion 232.

The second contact pin 3 comprises a pair of resilient beams 33, a contact portion 31 opposite to the resilient beams 33, and a pair of second blocking portions 32 between the resilient beams 33 and the contact portion 31. The contact portion 31 is used to contact with the chip. The pair of resilient beams 33 have a slot 333 defined therebetween. The resilient beams 33 are formed with a pair of hook portions 334 extending toward each other along the longitudinal direction. Each hook portion 334 is formed with a guiding face 3341. The second contact pin 3 includes a pair of opposite first side faces 301 parallel with the first side faces 201 of the first contact pin 2, and a pair of opposite second side faces 302 parallel with the second side faces 202 of the first contact pin 2. The pair of second blocking portions 32 project along the longitudinal direction from opposite second side faces 302.

In assembly of the contact 1, the coiled spring 4 is encircled around the first contact pin 2 and is supported by the first blocking portions 22. The second contact pin 3 is inserted into the coiled spring 4 for mating with the first contact pin 2 along a mating direction, with the coiled spring 4 confined between the first blocking portions 22 and the second blocking portions 32. The pair of resilient beams 333 are inserted within the grooves 25. The mating direction, the transverse direction and the longitudinal direction are orthogonal with each other. The longitudinal direction is orthogonal to the second side face 202, 302.

Figure 4:
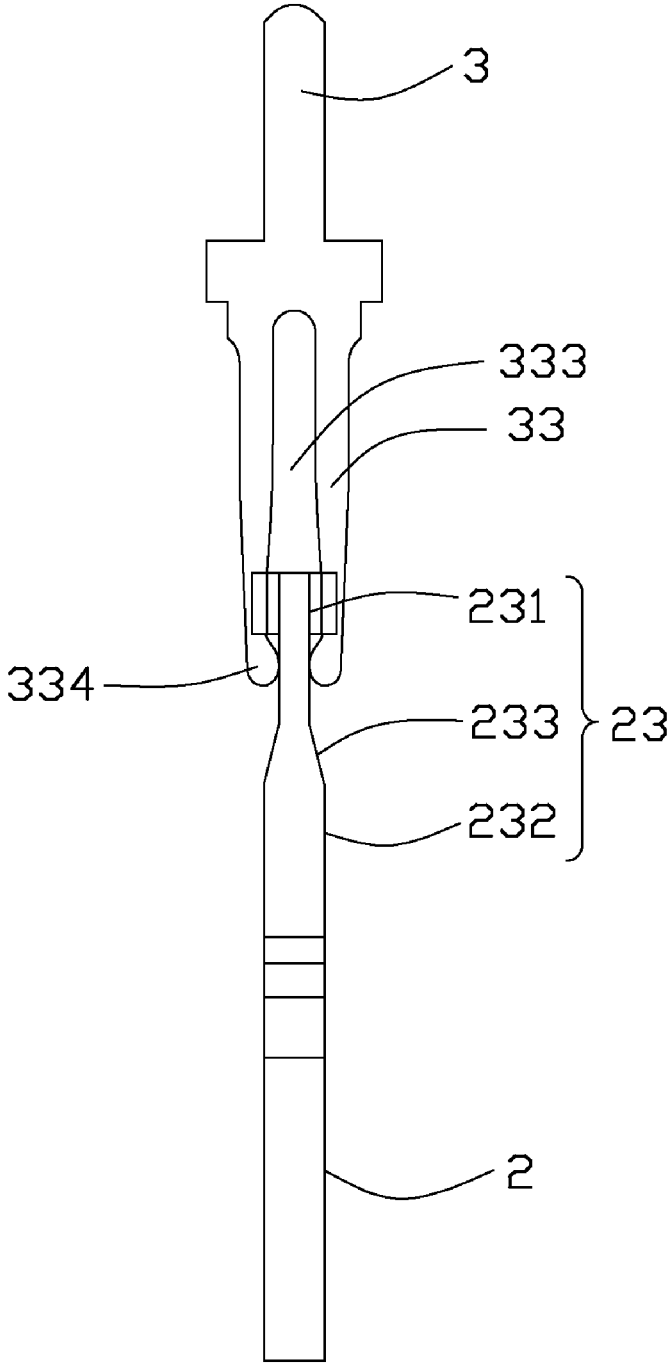
FIG. 4 is a schematic view showing the first contact pin and the second contact pin disposed in the unlatched position.

Referring to FIG. 1, in conjunction with FIG. 4, the contact 2 is located in an unlatched position. The resilient beams 33 are disposed adjacent to the second side faces 202 of the second body portion 231. The resilient beams 33 are spaced from the second body portion 231 a short distance or are just in contact with the second body portion 231. The hook portions 334 are resisted against the ear portions 24.

Figure 2:
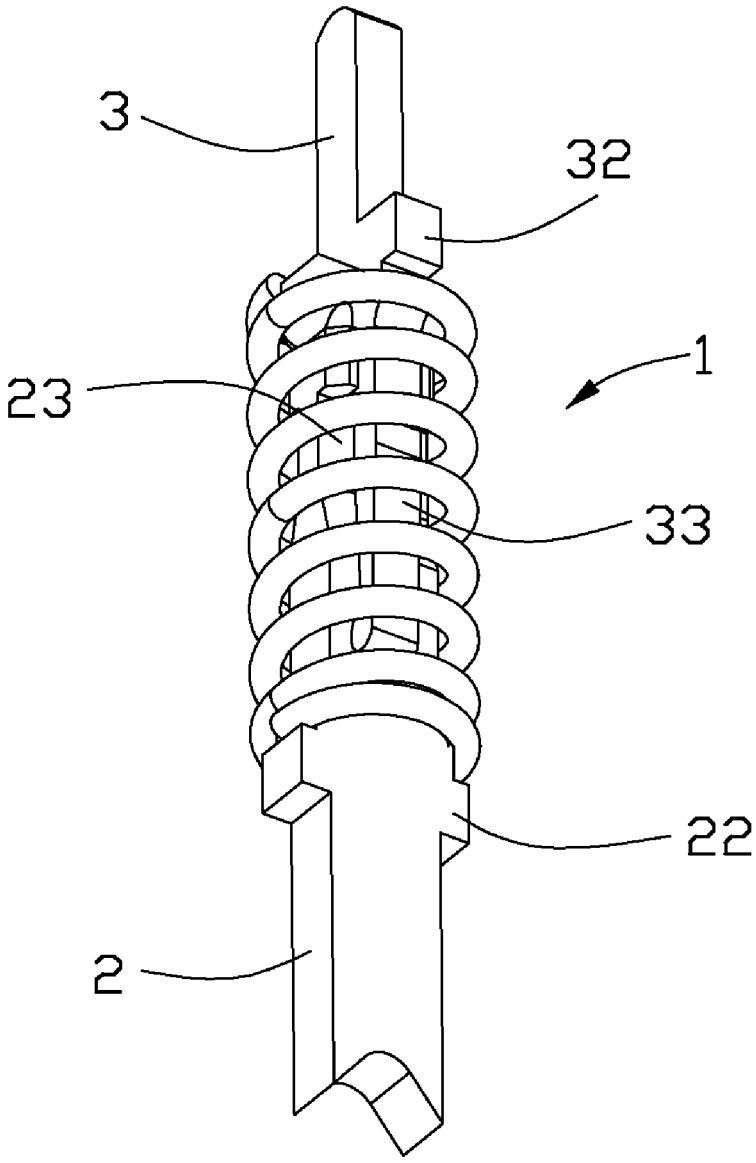
FIG. 2 is an assembled perspective view showing the contact disposed in a latched position.
Figure 3:
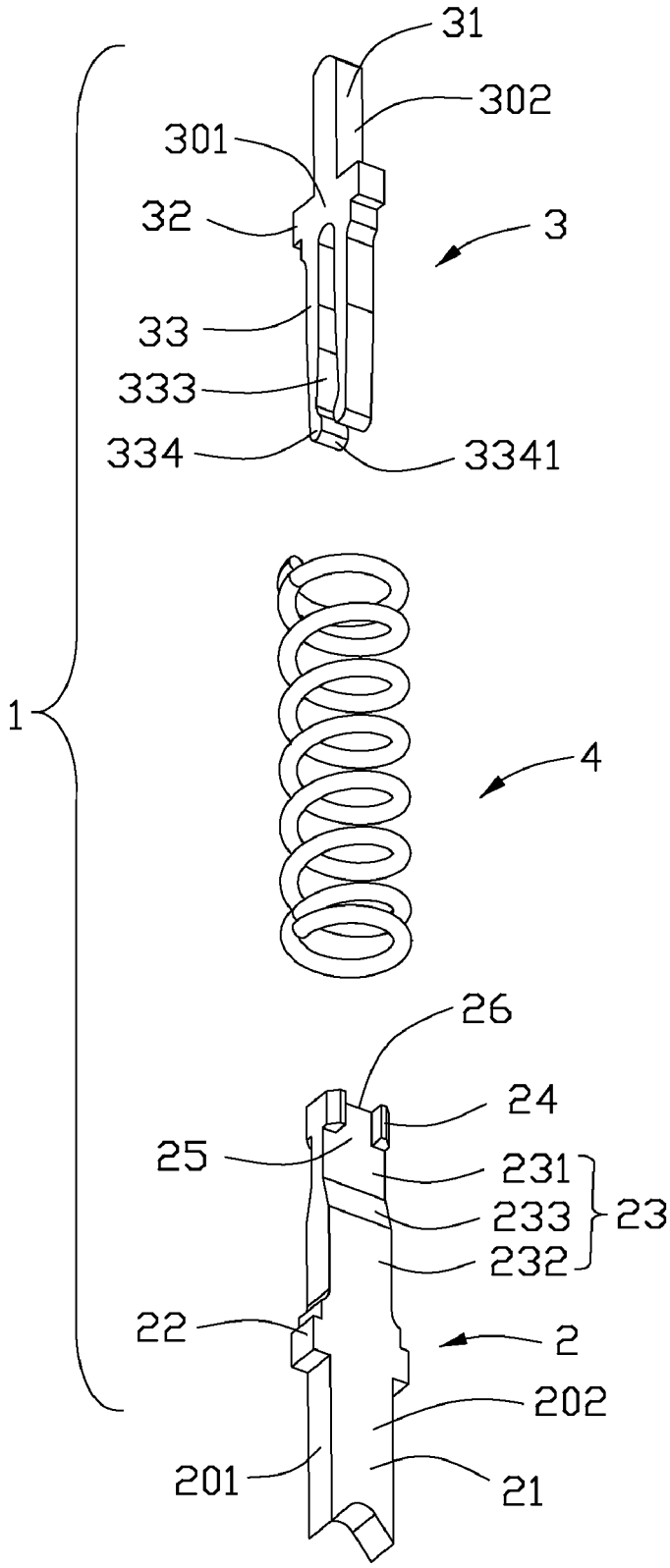
FIG. 3 is an exploded perspective view showing the contact.
Figure 5:
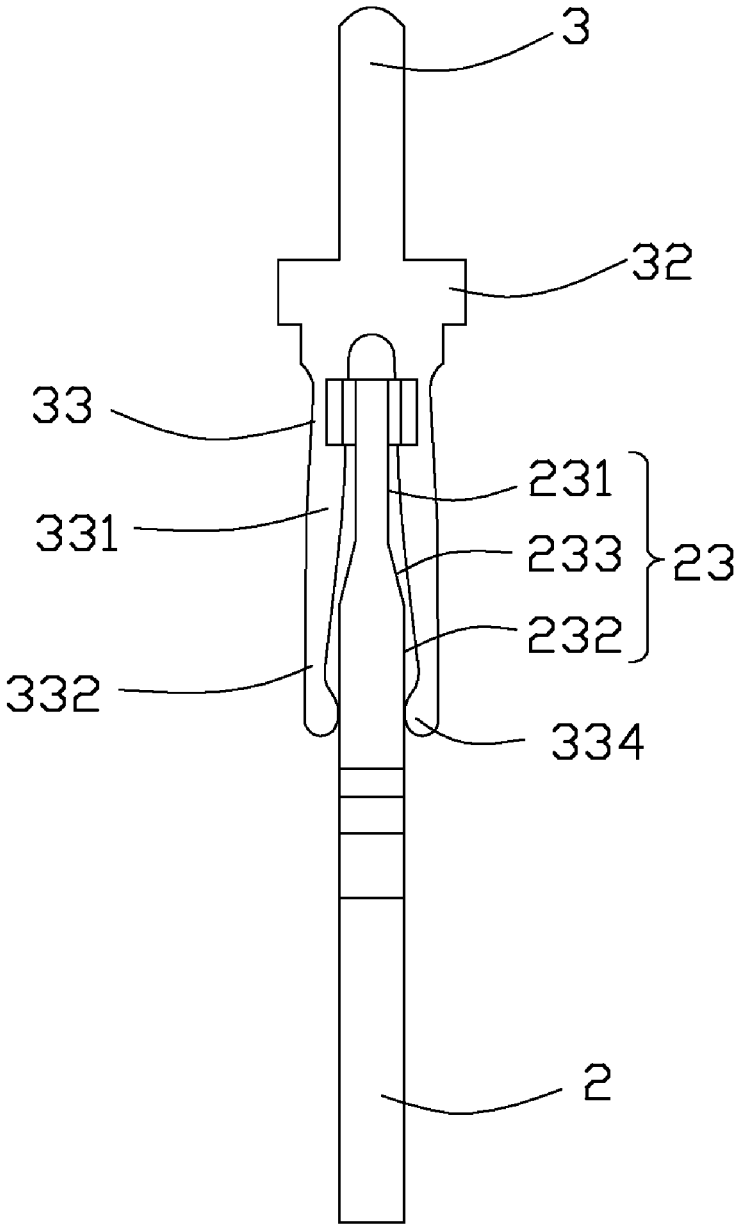
FIG. 5 is a schematic view showing the first contact pin and the second contact pin disposed in the latched position.

Referring to FIG. 2, in conjunction with FIG. 5, when the coiled spring 3 is compressed, the contact 1 is located in a latched position. The hook portions 334 of the second contact pin 3 slide along the mating direction over the connecting portion 233 and clasp the first body portion 232 of the first contact pin 2 along the longitudinal direction. The second body portion 231 of the body 23 is inserted into the slot 333 of the second contact pin 3. The second body portion 231 of the first contact pin 2 is suspended in the slot 333 and would not contact with the resilient beams 33, since the thickness of the second body portion 231 is thinner than that of the first body portion 232.

Referring to FIG. 1, in conjunction with FIG. 4, when the second contact pin 3 is released, the second contact pin 3 returns to the unlatched position under the restoring force generated from the coiled spring 4. The hook portions 334 of the second contact pin 3 are resisted against the ear portions 24 of the first contact pin 2 along another force generated along the mating direction, to prevent the second contact pin 3 from being dropped off the first contact pin 2.

The resilient beam 33 of the second contact pin 3 is confined between the pair of ear portions 24 of the first contact pin 2. Therefore, the resilient beam 33 is restrict to have a movement along the mating direction, and is prevented from moving along the transverse direction.

The first body portion 232 has a thickness greater than that of the second body portion 231. The resilient beams 33 are not in contact with the second body portion 231 or are just in contact with the second body portion 231 in the unlatched position. The resilient beams 33 and the body 23 would not endure any strong force in the unlatched position and would be protected from being distorted. The resilient beams 33 would not contact with the second body portion 231 in the latched position. The resilient beams 33 would be protected from being broken under the insertion of the second body portion 231. Additionally, since the resilient beams 33 would not contact with the first body portion 231 in the latched position, the resilient beams 33 could be formed into a greater dimension in thickness to strengthen the resilient beams 33.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact comprising:

a first contact pin comprising a mating end, a body having a first body portion and a second body portion, a pair of ear portions proximate to the mating end, and a pair of first blocking portions, said first body portion being distal from the mating end and having a thickness greater than that of the second body portion; and a second contact pin mating with the first contact pin along a mating direction, said second contact pin comprising a pair of second blocking portions, and a pair of resilient beams slidable between a latched position and an unlatched position, said resilient beams being confined by the ear portions to move along the mating direction, the resilient beams clasping the first body portion in the latched position; and a spring compressible between the pair of first blocking portions and the pair of second blocking portions.

2. The contact as claimed in claim 1, wherein said second body portion is disposed nearer to the mating end than the first body portion.

3. The contact as claimed in claim 2, wherein each of the first and second contact pins has a pair of opposite first side faces and a pair of opposite second side faces perpendicular to the first side faces.

4. The contact as claimed in claim 3, wherein said pair of ear portions project along a first direction perpendicular to the mating direction from the second body portion and are located at opposite sides of the second body portion.

5. The contact as claimed in claim 4, wherein each second side face of the first contact pin defines a groove between the pair of ear portions, each resilient beam of the second contact pin being confined in the groove and restricted to have a movement along said mating direction.

6. The contact as claimed in claim 4, wherein said pair of resilient beams are formed with a pair of hook portions extending toward each other along the first direction.

7. The contact as claimed in claim 1, wherein said body of the first contact pin comprises an obliquely extending connecting portion between the first and the second body portions.

8. The contact as claimed in claim 7, wherein said resilient beams are distanced from or are just in contact with the second body portion at the unlatched position.

9. The contact as claimed in claim 7, wherein said second contact pin has a slot between the pair of resilient beams, said second body portion disposed in the slot in the latched position.

10. The contact as claimed in claim 9, wherein said second body portion is suspended in the slot in the latched position.

11. The contact as claimed in claim 4, wherein said first blocking portions project along a second direction perpendicular to the first and the mating directions from the first side faces of the first contact pin, and wherein said second blocking portions project along the first direction from the second side faces of the second contact pin.

12. The contact as claimed in claim 1, wherein said first contact pin is formed with a mounting portion connected with the body for being mounted on a circuit board.

13. The contact as claimed in claim 1, wherein said second contact pin is formed with a contact portion opposite to the resilient beams for contacting with a chip.

14. A contact assembly comprising:

a first contact pin having a first front section and a first rear section commonly extending in a first lengthwise direction perpendicular to a first thickness direction thereof; and a second contact pin having a second front section and a second rear section commonly extending toward the first contact pin in a second lengthwise direction opposite to said first lengthwise direction and perpendicular to a second direction which is perpendicular to the first thickness direction, under condition that the first contact pin and the second contact pin are mated with each other in said opposite first lengthwise direction and said second lengthwise direction to have the first front section of the first contact pin and the second front section of the second contact pin confront each other in said first thickness direction at an initial mating stage and to have the first front section confront the second rear section and the second front section confront the first rear section in said first thickness direction at a final mating stage; wherein a first contacting section of the first contact pin, which is defined by said first front section and the first rear section, is clamped, in said first thickness direction, by a clamping structure of a second contacting section of the second contact pin which is defined by said second front section and said second rear section;

at least either the first front section defines a less dimension than the first rear section in said first thickness direction or the second front section defines a less dimension than the second rear section in said first thickness direction so as to achieve a lower mating normal force between the first contact pin and the second contact pin at the initial stage and a higher mating marl force between the first contact pin and the second contact pin at the final mating stage.

15. The contact assembly as claimed in claim 14, wherein the second contacting section includes a pair of resilient beams commonly sandwiching the first contacting section therebetween in said first thickness direction.

16. The contact assembly as claimed in claim 15, wherein the first contact pin defines two opposite surfaces in the first thickness direction, and each of said surfaces defines a pair of ear portions to confine the corresponding resilient beam of the second contacting section.

17. The contact assembly as claimed in claim 16, wherein said pair of ear portions are located at the first front section.

18. The contact assembly as claimed in claim 17, wherein the first front section is thinner than the first rear section in said first thickness direction.

19. The contact assembly as claimed in claim 15, wherein a pair of hook portions are formed on free ends of the pair of resilient beams, respectively, in the second thickness direction.

20. The contact assembly as claimed in claim 14, wherein the first front section is thinner than the first rear section in said first thickness direction while the second front section is dimensioned same with the second rear section in said first thickness direction.

* * * * *